US008944537B1

(12) United States Patent
Manalang et al.

(10) Patent No.: US 8,944,537 B1
(45) Date of Patent: Feb. 3, 2015

(54) DRAWER LATCH ASSEMBLY A TOOLBOX ASSEMBLY

(71) Applicants: Edwin Dizon Manalang, Burbank, IL (US); Larry Mitchell Grela, Plainfield, IL (US)

(72) Inventors: Edwin Dizon Manalang, Burbank, IL (US); Larry Mitchell Grela, Plainfield, IL (US)

( * ) Notice: Subject to any disclaimer, the term of this patent is extended or adjusted under 35 U.S.C. 154(b) by 0 days.

(21) Appl. No.: 13/998,268

(22) Filed: Oct. 17, 2013

(51) Int. Cl.
*A47B 95/02* (2006.01)
*E05B 65/46* (2006.01)
*A47B 81/00* (2006.01)

(52) U.S. Cl.
CPC ..... *E05B 65/463* (2013.01); *A47B 81/00* (2013.01); *E05B 65/46* (2013.01)
USPC ..... 312/332.1; 312/319.2

(58) Field of Classification Search
CPC ..... E05B 65/46; E05B 3/16; A47B 95/02
USPC ..... 312/319.1–319.2, 332.1
See application file for complete search history.

(56) References Cited

U.S. PATENT DOCUMENTS

| | | | | |
|---|---|---|---|---|
| 1,987,822 | A | 1/1935 | Gregory | |
| 2,286,427 | A | 6/1942 | Levensten | |
| 2,525,208 | A | 9/1946 | Clink | |
| 3,239,298 | A * | 3/1966 | McCarthy | 312/234.3 |
| 3,520,583 | A | 7/1970 | Case | |
| 3,848,942 | A | 11/1974 | Fanini | |
| 3,954,202 | A | 5/1976 | Petrick | |
| 4,040,695 | A * | 8/1977 | Brann | 312/348.6 |
| 4,108,514 | A | 8/1978 | Zimmerman | |
| 4,211,455 | A | 7/1980 | Tedrow | |
| 4,266,835 | A | 5/1981 | Schmidt | |
| 4,303,158 | A | 12/1981 | Perkins | |
| 5,292,191 | A | 3/1994 | Slivon | |
| 5,630,630 | A * | 5/1997 | Price et al. | 292/128 |
| 5,927,838 | A | 7/1999 | Hellman | |
| 5,951,129 | A | 9/1999 | Stein | |
| 6,375,235 | B1 | 4/2002 | Mehmen | |
| 6,422,386 | B1 | 7/2002 | Wiese et al. | |
| 6,527,353 | B1 | 3/2003 | Bradfish et al. | |
| 6,547,289 | B1 * | 4/2003 | Greenheck et al. | 292/126 |
| 6,851,286 | B2 * | 2/2005 | Dube et al. | 70/81 |
| 7,048,347 | B1 * | 5/2006 | Liu | 312/332.1 |
| 7,121,638 | B1 | 10/2006 | Eggert et al. | |
| 7,296,808 | B2 | 11/2007 | Huguet | |
| RE40,267 | E | 4/2008 | Mehmen | |
| D574,628 | S | 8/2008 | Grela | |
| 7,510,078 | B2 | 3/2009 | Schmidt et al. | |
| 7,552,950 | B2 | 6/2009 | Scheffy et al. | |
| 7,784,887 | B2 | 8/2010 | Grela et al. | |
| D636,615 | S | 4/2011 | Grela | |
| 7,946,663 | B2 | 5/2011 | Holcomb | |
| D649,377 | S | 11/2011 | Manalang et al. | |
| 8,056,943 | B2 | 11/2011 | Scheffy et al. | |
| 8,056,995 | B2 | 11/2011 | Grela et al. | |
| 8,084,992 | B2 | 12/2011 | Scheffy et al. | |
| 8,136,849 | B2 * | 3/2012 | Hakemann | 292/95 |

(Continued)

OTHER PUBLICATIONS

International Search Report for PCT Application Number: PCT US2010/001732, Aug. 5, 2010.

(Continued)

*Primary Examiner* — Hanh V Tran
(74) *Attorney, Agent, or Firm* — John G. Chupa

(57) ABSTRACT

A container 10 having a latch assembly 40 which reduces the likelihood that a drawer 16 will undesirably and/or inadvertently move to an open position.

4 Claims, 6 Drawing Sheets

(56) References Cited

U.S. PATENT DOCUMENTS

| | | | | |
|---|---|---|---|---|
| 8,157,337 | B2 | 4/2012 | Manalang et al. | |
| 8,240,786 | B2 | 8/2012 | Daino et al. | |
| D678,694 | S | 3/2013 | Grela | |
| 8,608,261 | B2 * | 12/2013 | Retchloff et al. | 312/332.1 |
| 2005/0204646 | A1 | 9/2005 | Tupper et al. | |
| 2006/0103278 | A1 * | 5/2006 | Bousquet | 312/332.1 |
| 2008/0150407 | A1 | 6/2008 | Mehmen | |
| 2008/0276667 | A1 | 11/2008 | Scheffy et al. | |
| 2010/0072716 | A1 | 3/2010 | Grela | |
| 2010/0276317 | A1 | 11/2010 | Grela et al. | |
| 2010/0282629 | A1 | 11/2010 | Grela | |
| 2010/0314978 | A1 | 12/2010 | Manalang et al. | |
| 2011/0050066 | A1 * | 3/2011 | Lee et al. | 312/404 |
| 2011/0121701 | A1 * | 5/2011 | Chang | 312/332.1 |
| 2011/0309730 | A1 * | 12/2011 | Retchloff et al. | 312/332.1 |

OTHER PUBLICATIONS

United States Trademark Registration Number: 3,930, 484.
Matco Tools Catalog at least as early as Oct. 29, 2014.

* cited by examiner

Fig. 2
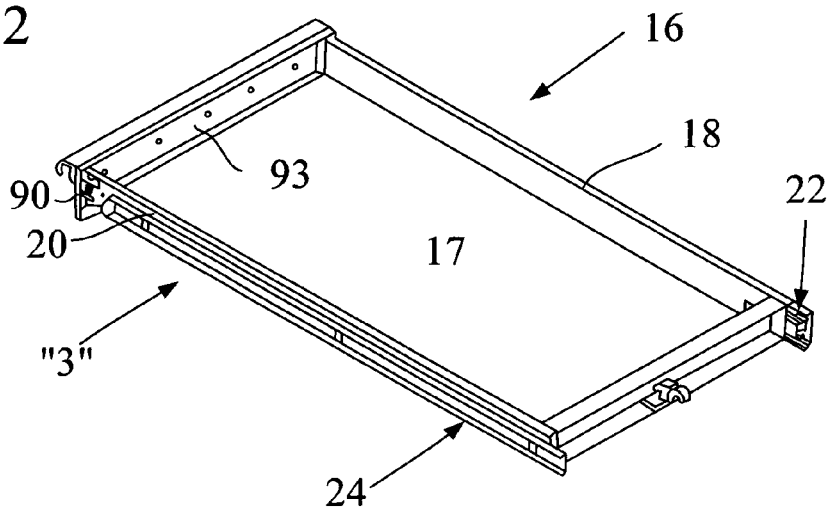
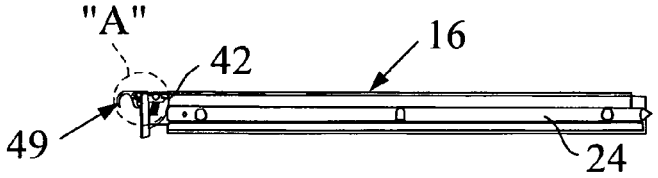
Fig. 3
Fig. 4
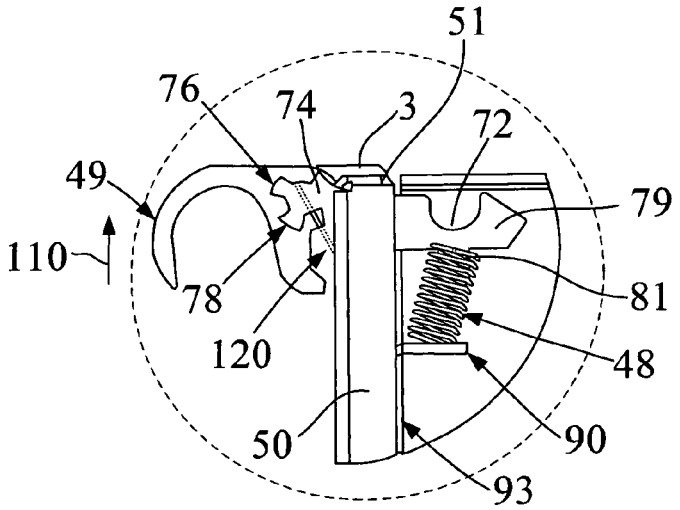

Fig. 10
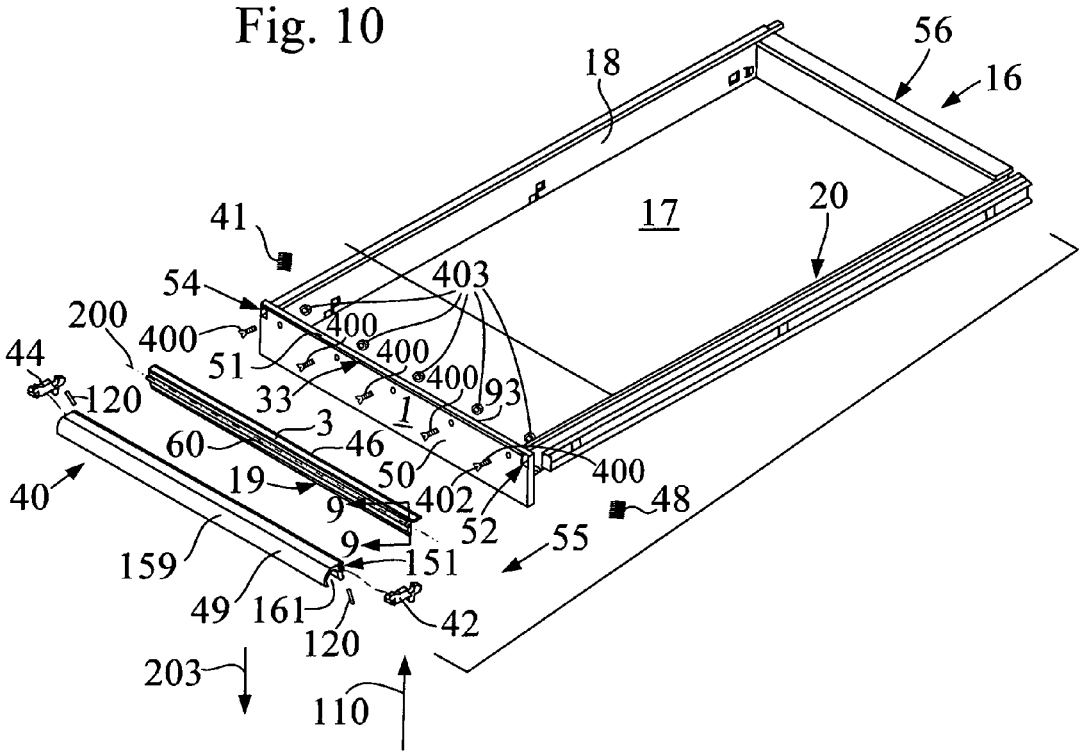
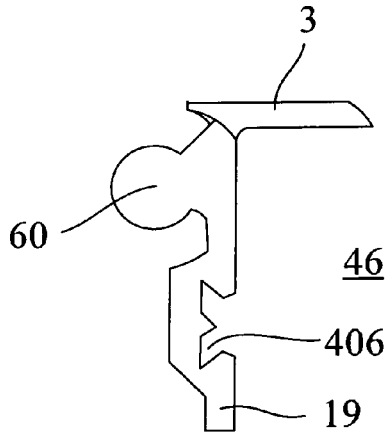
Fig. 11

DRAWER LATCH ASSEMBLY A TOOLBOX ASSEMBLY

GENERAL BACKGROUND

1. Field of the Invention

The present invention generally relates to a drawer latch assembly and more particularly to a drawer latch assembly for use within a container, such as and without limitation a tool box assembly, and to a toolbox assembly which incorporates the drawer latch assembly.

2. Background of the Invention

Containers, such as toolboxes, are used to selectively store items, such as tools. One attribute of such assemblies is that they are capable of being movable between a selectively open position in which the stored items are easily accessible and a closed position in which the items are hidden from view and made inaccessible. In this closed position, the stored items safely reside within the container.

Typically these containers include at least one drawer which receives the items, which movably resides within the body of the container, and which is selectively movable between these operable states. In the selectively closed position, the at least one drawer resides within the container and prevents access to the contained items. While these drawers do selectively contain these items and do allow them to be selectively stored and accessed, they may undesirably move from the closed to the open position when the container is moved or tipped. Such undesirable movement may cause the contained items to fall from the drawers and to strike an individual or the floor, thereby causing injury or damage, or being damaged themselves. While these drawers may be locked, by the use of a key, thus preventing such undesirable movement, often the key is misplaced or the user forgets to lock such drawers. Thus, such undesirable and/or inadvertent drawer movement even occurs when a "lock and key" assembly is utilized.

There is therefore a need for a latch assembly which automatically (without user intervention), prevents inadvertent movement of these drawers into an open position. The present invention provides for such a latch assembly and for a container incorporating such a latch assembly.

SUMMARY OF THE INVENTION

It is a first non-limiting object of the present inventions to provide a latch assembly which may be used with a container and which reduces the likelihood of the container being moved to an open position in an inadvertent manner.

It is a second non-limiting object of the present invention to provide a container having at least one drawer which is selectively movable between an open and closed position and which has a latch assembly which automatically latches the at least one drawer when the at least one drawer is in the closed position.

According to a third non-limiting aspect of the present invention, a drawer latch assembly for use with a drawer of the type having a front face which terminates into a run along a top edge is provided. The drawer latch assembly comprising a pivot member which is fixedly attached to a first surface of the front face, beneath said run, which is longitudinally coextensive to the front face, and which includes a central rounded protrusion which extends from the first surface of the front face beneath the run; a latch plate which has a first end which extends through the first surface of the front face and which has a second end; a spring which is coupled to the second end of the latch plate and to a second surface of said front face; and a handle which is coupled to the pivot member and which is movable from a first position in which the latch plate prevents movement of the drawer to a second position in which the latch plate allows said movement of said drawer and wherein the spring biases the handle in the first position.

According to a fourth non-limiting aspect of the present invention, a tool box assembly is provided and comprises a body; a drawer which is selectively and movably disposed within the body and having a front face which terminates into a horizontal run; and a drawer latch assembly comprising a pivot member which is fixedly positioned upon the front face and below the horizontal run and wherein the pivot member having a rounded portion which is longitudinally coextensive to the front face and which protrudes away from the front face, the drawer latch assembly further having at least one latch member which traverses the front face and which includes a first end which protrudes away from the front face in a similar direction to the direction that the rounded portion of the pivot member protrudes from the front face and wherein the at least one latch member includes a second end; a pin which is fixedly disposed within the body, a spring which is coupled to said at least one latch member and to the body, and a handle which is coupled to the pivot member and to the spring and which is selectively movable from a first position in which the spring causes the second end of said latch member to engage the pin, thereby preventing said drawer from being appreciably moved to a second position in which the latch is disengaged from the pin, thereby allowing said drawer to be moved to an open position According to a fifth non-limiting aspect of the present invention, there is provided a drawer latch assembly for use with a drawer which may be selectively moved from a first closed position to a second open position and which includes a face which terminates onto a horizontal run, the drawer latch assembly having a portion which traverses the face, which is wholly positioned below the horizontal run, and which is selectively pivotal about an axis which lies below the horizontal run and which selectively prevents the drawer from being moved from the first closed position to the second open position These and other features, aspects, and advantages of the present inventions will become apparent from a reading of the detailed description of the preferred embodiments of the inventions (including the subjoined claims) and by reference to the following drawings.

BRIEF DESCRIPTION OF THE DRAWINGS

FIG. 2 is a perspective view of one of the drawers which are shown in FIG. 1.

FIG. 3 is a side view of the drawer shown in FIG. 2 taken in the direction of view arrow "3".

FIG. 4 is an exploded view of the corner of the drawer which is shown as area "A" in FIG. 3.

FIG. 10 is a partial perspective view of the drawer which is shown in FIG. 5 and made in accordance with the teachings of a second embodiment of the invention.

FIG. 11 is a view similar to that of FIG. 9 but showing a second embodiment of the invention.

DETAILED DESCRIPTION OF THE PREFERRED EMBODIMENTS OF THE INVENTION

Figure 1:
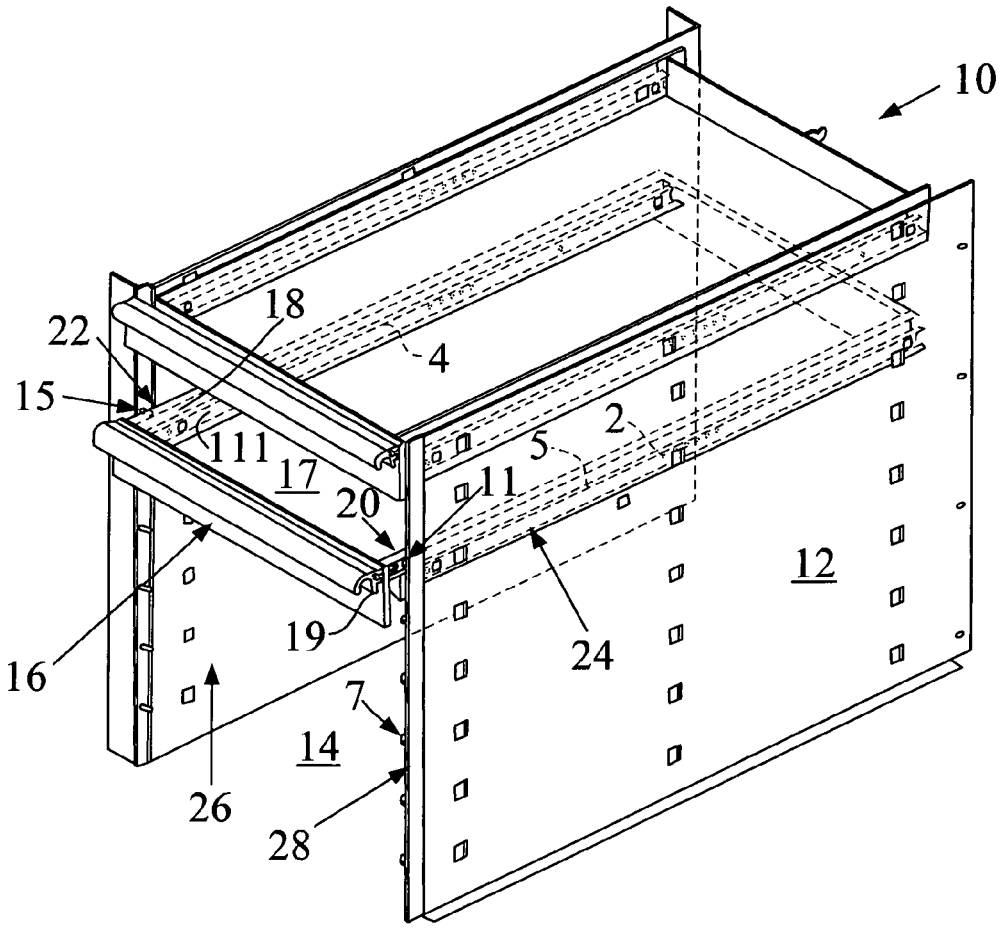
FIG. 1 is a perspective partial unassembled view of a toolbox which is made in accordance with the teachings of the most preferred embodiment of the invention.
Figure 5:
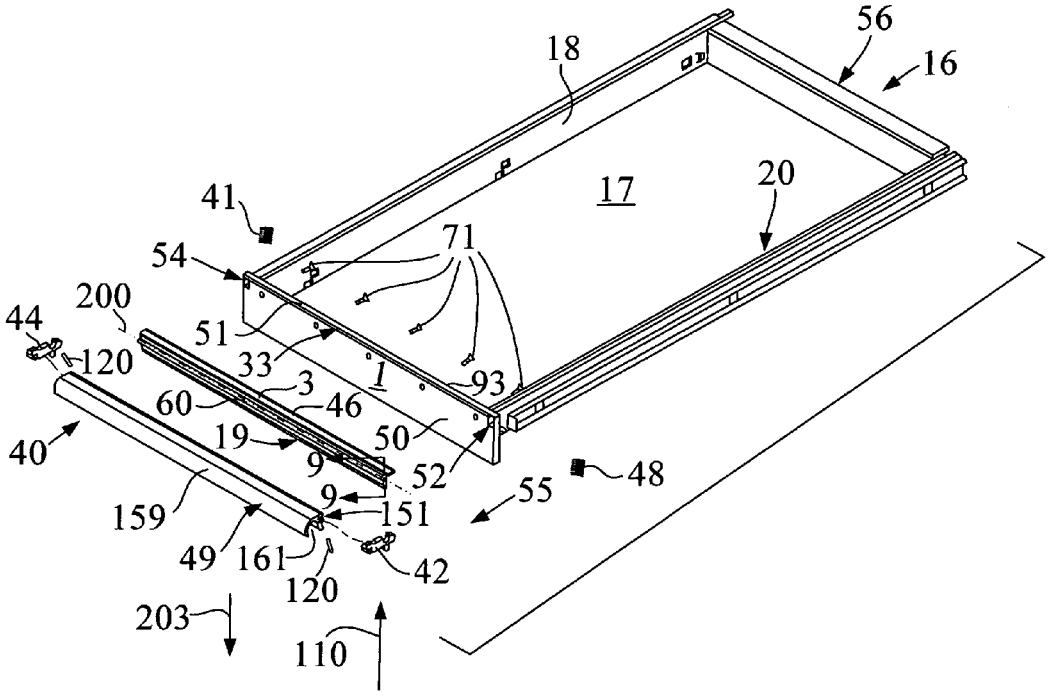
FIG. 5 is an unassembled perspective view of the drawer which is shown in FIG. 2.
Figure 6:
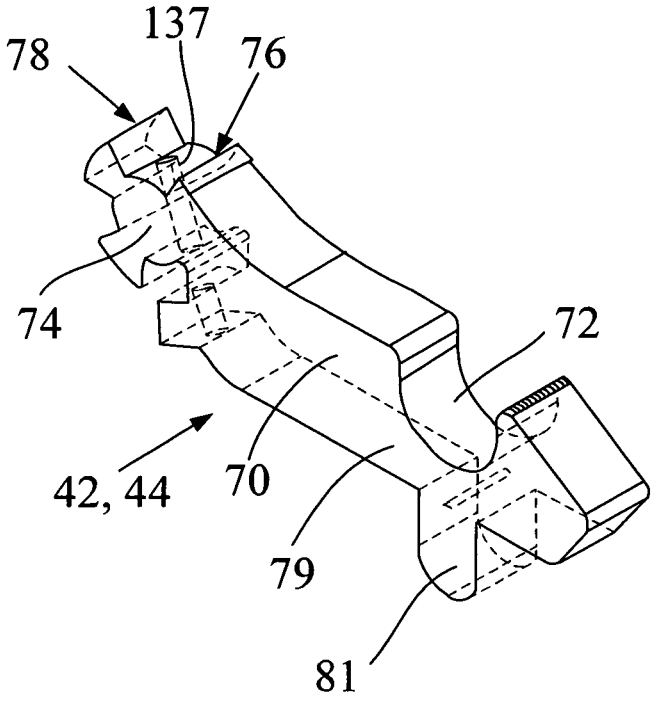
FIG. 6 is a perspective exploded view of one of the latch members which are shown in FIG. 5.

Referring now to FIGS. 1-9, there is shown a container 10 which is made in accordance with the teachings of the most preferred embodiment of the various inventions. Container 10 may be a toolbox or substantially any other type of container and nothing in this description limits the container to a particular type of storage assembly or to any particular size or shape.

The container 10 includes a generally hollow body 12 having at least one internal containment cavity 14 into which at least one drawer 16 is moveably deployed. That is, the at least one drawer 16 includes an item containment portion 17 into which various items may be selectively placed, and opposed side surfaces 18, 20 upon which respective and substantial identical rail assemblies 22, 24 are deployed and which are movably and respectively coupled to container sidewalls 26,28 in a known manner. Thus the rail assemblies 22, 24 cooperatively allow the at least one drawer 16 to be selectively moved between a closed position in which the at least one drawer 16 (i.e., the containment portion 17) resides within the cavity 14, to an open position in which the drawer containment portion 17 is moved outside of the containment cavity 14. In one non-limiting embodiment, the rail assemblies cooperate with respective rails 5, 111 (not shown) disposed on sidewalls 18, 20 to allow such movement in a known and conventional manner. That is, rail 5 is movably coupled to stationary rail 24 by bearing 2 (in one non-limiting embodiment) and rail 111 is similarly and movably coupled to rail 22. Other coupling strategies may be utilized and bearings 2 may not be used in these other strategies. The body 12 includes a plurality of substantially identical pins 7 which extend into the cavity 14. Particularly, pins 7 are disposed upon the sidewalls 26, 28 and orthogonally project from these sidewalls 18, 20 into the formed internal cavity 14.

Importantly, according to the present inventions, the container 10 includes a new and novel drawer latch assembly 40 which reduces the likelihood that the at least one drawer 16 will be undesirably and/or inadvertently moved to the open position.

Particularly, the latch assembly 40 (as shown in FIGS. 1-9), includes a pair of substantially identical latch members 42, 44, a base or pivot member assembly 46, a pair of substantially identical springs 41, 48, and a release lever or handle member 49. Each drawer, such as drawer 16, which is movably disposed within the container 10 includes a respective and substantially identical latch assembly 40. Each drawer is also substantially identical and operates in the manner described with respect to the at least one drawer 16.

Specifically, the at least one drawer 16 includes a generally flat front face portion 50 which terminates into a horizontal run or race 51 along a top edge 33 and the flat front face portion 50 includes a pair of substantially identical, generally rectangular, and opposed slots 52, 54 which are formed at upper and opposed respective corners. The term "upper" means the portion of the face 50 closest to the run 51. The face portion 50 is coupled to the side wall portions 18, 20 and cooperates with these side portions 18, 20 and the back wall portion 56 (which is also coupled to the side wall portions 18, 20) to form the item containment portion 17. The foregoing coupling arrangement of these drawer portions 18, 20, 50, and 56, may be achieved by the use of pins or other known mechanical or material type of fastener strategies.

The base assembly or pivot member 46 includes a lower portion 19 having a flat surface 181 which is coupled upon and onto the front face portion 50, beneath the run 51, and which is longitudinally coextensive to the front face portion 50. The base assembly or a pivot member 46 also includes an integrally formed and generally rounded portion 60 which, when the surface 181 of the portion 19 is attached to front surface 1 of face 50, extends from the front face 50 in the direction 55. The coupling of the base assembly or pivot member 46 may be done by use of a plurality of screws 71 which traverse both the front face member 50 and the base member or pivot member 46. Both the portion 19 and the portion 60 lie below the run 51 and the member or assembly 46 includes a top flange 3 which sits upon the run 51 when the member or assembly 46 is attached to the face 50.

Each latch 42, 44 includes an elongated body 70 having a slot 72 disposed proximate to a first end 79, and a second opposed end 74 which includes several formed protuberances 76, 78. End 79 of latch member 42 traverses slot 52, while respective end 79 of latch member 44 traverses slot 54. Each end 79 further includes a respective projection portion 81 which orthogonally projects from body 70 toward containment portion 17 when latches 42, 44 respectively traverse slots 52, 54. Portion 81 of latch member 42 is received by the biasing spring 48 which resides upon ledge 90. Respective portion 81 of latch member 44 is received by biasing spring 41 which resides upon a ledge similar to ledge 90. The ledges, such as ledge 90, are coupled to and orthogonally project from opposed ends of back surface 93 of the front member 50.

Respective ends 74 of latch members 42, 44 are received by the lever member 49 and respective and substantially identical pins 120, in one non-limiting embodiment, couple the respective ends 74 to the lever member 49. That is, the pins 120 are received within respective slots 137 formed in each of the members 42, 44. Moreover, That is, lever member 49 has a formed channel 151 which has a shape complimentary to protuberances 76, 78. The term "complimentary" means that channel 151 frictionally and tightly receives these protuberances 76, 78 from respective latches 42, 44 and the channel 151 is linearly coextensive to the face portion 50. The lever member 49 includes a rounded handle portion 159 including a grasping channel 161 which is sized and adapted to selectively receive a human hand. Any motion imparted to member 49 is transferred to member or the latches 42, 44 because the protuberances 76, 78 are received within the channel 151. The member 46 is stationary (as it is coupled to the face 50 by screws 71) and portion 60 functions as a pivoting area, as described below.

Figure 7:
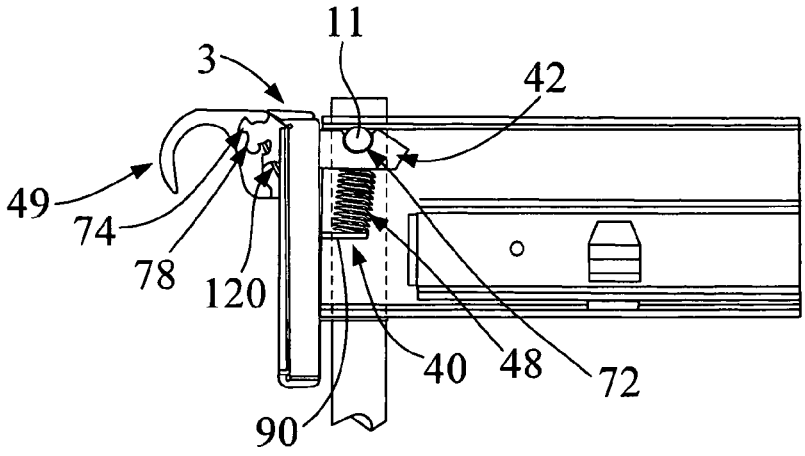
FIG. 7 is a partial side view of the drawer shown in FIGS. 2 and 5 in a selectively latched position.
Figure 8:
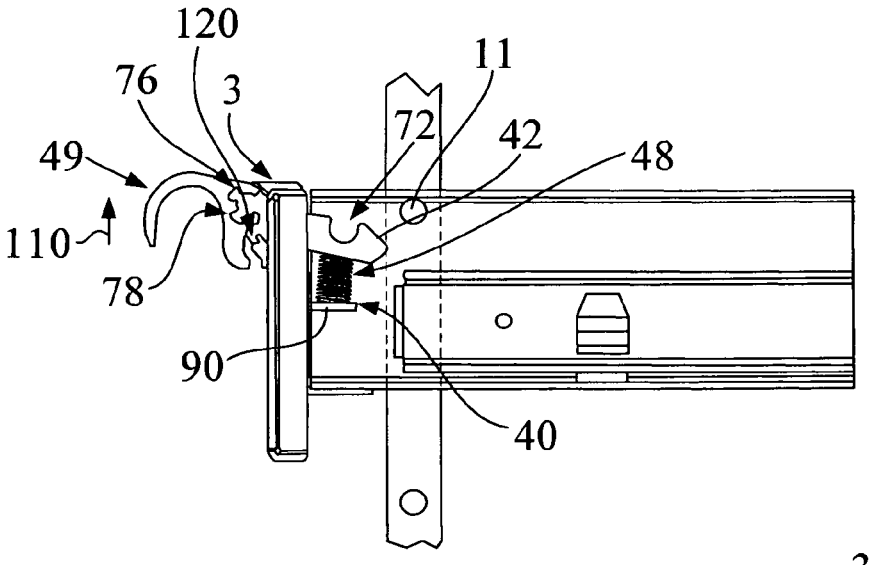
FIG. 8 is a partial side view of the drawer shown in FIG. 7 in a selectively unlatched position.
Figure 9:
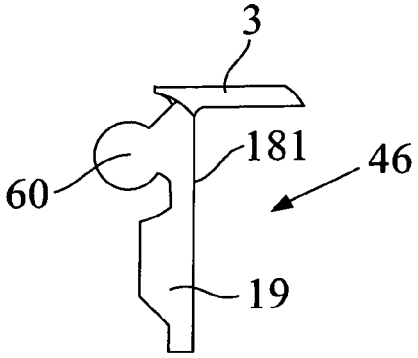
FIG. 9 is a side sectional view taken along view line 9-9 of the member shown in FIG. 5.

In operation, as is shown best perhaps in FIGS. 7 and 8, once the at least one drawer 16 is closed, the biasing springs 41, 48 respectively push the respective slots 72 against pins 11, 15 (which form part of the pin arrangement 7), thereby latching the at least one drawer 16 and reducing the likelihood that the at least one drawer 16 will inadvertently traverse to an open position. The pins 11, 15, residing in respective slots 72, don't allow appreciable movement of at least one drawer 16 in direction 55. When it is desired to move the at least one drawer 16 to the open position, the lever member 49 is moved upwards, in the direction of arrow 110, thereby causing portions 81 to respectively counteract the upward biasing force of springs 41, 48 and causing the pins 11, 15 to be disengaged from the respective slots 72, thereby allowing the at least one drawer 16 to be selectively moved to the open position. It should be appreciated that the lever member 49 pivots upon the pivot member 46, along a longitudinal axis 200 which comprises the longitudinal axis of symmetry of the portion 60, and axis 200 is beneath the run 51 and in front of the face 50. The term, "in front of the face 50", means away from the containment portion 17. The upward movement (in direction 110) of lever 49 causes ends 79 to move downwards (in direction 203) since latches 42, 44 are each coupled to lever 49. Thus, the pivoting of lever member 49 about axis 200, which is below and in front of the run 51, causes movement of the latch members 42, 44 and the movement of the latch members 42, 44 is dependent upon the movement of the lever member 49. By allowing the lever member 49 to pivot beneath and in front of the run 51, Applicant has found that pivoting may be easily accomplished by a user of container 10. When the at least one drawer 16 is closed, springs 41, 48 automatically (without user intervention) latch the at least one drawer 16 by forcing the respective slots 72 to receive respective pins 11, 15, thereby preventing the at least one drawers 16 from inadvertently opening.

In a second non-limiting embodiment, as best shown in FIGS. 10 and 11, a plurality of screws 400 may indeed traverse the face 50 but have their respective head 402 reside on the front surface 1 (opposite to back surface 93). The member 46, in this second non-limiting embodiment, includes a channel 406 (which is longitudinally co-extensive to portion 60) and which is adapted to frictionally receive these heads 402. The frictional reception of heads 402, within the channel 406, fixes the member 46 upon the front surface 1 of face 50. Nuts 403 may be used to selectively secure the screws 400 to the back surface 93 of the drawer 16. All other previously described aspects of the latch assembly 40 remain the same. This second embodiment obviates the need for holes to be created into and through the member 46, thereby reducing cost while still allowing the member 46 to be fixed to face 50.

It is to be understood that the inventions are not limited to the exact construction or methodology described above, but that various changes and modifications may be made without departing from the spirit and scope of the inventions as they are described in the following claims.

What is claimed is:

1. A drawer latch assembly for use with a drawer having a face member which terminates into a run along a top edge and wherein said face member having at least one slot which is positioned below and proximate to said run, said drawer latch assembly comprising a pivot member which is fixedly attached to a first broad surface of said face member, which is positioned beneath said run, which is longitudinally coextensive to said first member, and which includes a central rounded protrusion which is longitudinally co-extensive to said face member and which extends from said first broad surface of said face member beneath said run; a latch plate comprising an elongated body having a first pointed end, a slot disposed proximate to said first pointed end, and an orthogonally projecting portion which orthogonally projects away from said slot, wherein said latch plate further comprises a second opposed end which includes a plurality of protuberances which outwardly extend from said second opposed end and wherein said first end extends through said at least one slot away from said first surface of said face member; a spring which is coupled to said orthogonally projecting portion and to a second broad surface of said face member, said second surface being opposite from said first surface; and a lever member is longitudinally coextensive to and which is disposed upon said face member and which includes a central slot which receives said pivot member and which further receives each of said plurality of protuberances and which is movable from a first position in which said latch plate prevents movement of said drawer to a second position in which said latch plate allows movement to said drawer and wherein said spring biases said lever member to said first position.

2. A tool box assembly comprising a body; at least one drawer which is selectively and movably disposed within said body and wherein said drawer comprising a face member which terminates into a run along a top edge and wherein said face member having at least one slot which is positioned below and proximate to said run, a drawer latch assembly comprising a pivot member which is fixedly attached to a first broad surface of said face member, which is positioned beneath said run, which is longitudinally coextensive to said first member, and which includes a central rounded protrusion which is longitudinally co-extensive to said face member and which extends from said first broad surface of said face member beneath said run; a latch plate comprising an elongated body having a first pointed end, a slot disposed proximate to said first pointed end, and an orthogonally projecting portion which orthogonally projects away from said slot, wherein said latch plate further comprises a second opposed end which includes a plurality of protuberances which outwardly extend from said second opposed end and wherein said first end extends through said at least one slot away from said first surface of said face member; a spring which is coupled to said orthogonally projecting portion and to a second broad surface of said face member, said second surface being opposite from said first surface; and a lever member which is longitudinally coextensive to and which is disposed upon said face member and which includes a central slot which receives said pivot member and which further receives each of said plurality of protuberances and which is movable from a first position in which said latch plate prevents movement of said drawer to a second position in which said latch plate allows movement to said drawer and wherein said spring biases said lever member to said first position.

3. The tool box assembly of claim 2 further including a pin which is received within said pivot member and which couples said elongated body of said pivot member to said lever member.

4. The tool box assembly of claim 3 further comprising a ledge which orthogonally projects away from said second broad surface and upon which said spring resides.

* * * * *